US008953415B2

(12) United States Patent
Goeller

(10) Patent No.: US 8,953,415 B2
(45) Date of Patent: Feb. 10, 2015

(54) TIMEPIECE MOVEMENT INCLUDING AN INSTANTANEOUS ACTUATOR CONTROLLED BY THE MOVEMENT

(75) Inventor: Eric Goeller, Les Hôpitaux Vieux (FR)

(73) Assignee: Montres Breguet SA, L'abbaye (CH)

( * ) Notice: Subject to any disclaimer, the term of this patent is extended or adjusted under 35 U.S.C. 154(b) by 107 days.

(21) Appl. No.: 13/426,303

(22) Filed: Mar. 21, 2012

(65) Prior Publication Data

US 2012/0243388 A1 Sep. 27, 2012

(30) Foreign Application Priority Data

Mar. 23, 2011 (EP) ..... 11159387
Mar. 23, 2011 (EP) ..... 11159422

(51) Int. Cl.
*G04B 19/24* (2006.01)
*G04B 19/20* (2006.01)
*G04B 13/00* (2006.01)
*G04B 19/253* (2006.01)

(52) U.S. Cl.
CPC ..... *G04B 13/003* (2013.01); *G04B 19/25373* (2013.01)
USPC ..... 368/28; 368/37; 368/38

(58) Field of Classification Search
USPC ..... 368/28–40, 169
See application file for complete search history.

(56) References Cited

U.S. PATENT DOCUMENTS 3,451,211 A * 6/1969 Nakagawa ..... 368/38
3,818,692 A * 6/1974 Zaugg et al. ..... 368/38
3,882,669 A * 5/1975 Jakob ..... 368/38
4,136,514 A * 1/1979 Rochat ..... 368/28
4,372,687 A * 2/1983 Krasovsky et al. ..... 368/28
7,158,448 B1 * 1/2007 Gabathuler et al. ..... 368/37
7,408,844 B2 * 8/2008 Zaugg et al. ..... 368/31
7,871,197 B2 * 1/2011 Wyssbrod ..... 368/106
2005/0128875 A1 * 6/2005 Bron ..... 368/21
2009/0016169 A1 * 1/2009 Villar et al. ..... 368/38
2011/0286311 A1 * 11/2011 Ono ..... 368/38
2012/0014224 A1 * 1/2012 Gabathuler et al. ..... 368/38

FOREIGN PATENT DOCUMENTS

CH 496 272 A 5/1970
EP 1 544 691 A1 6/2005
EP 1 746 470 A1 1/2007
FR 2 232 788 A1 1/1975

* cited by examiner

*Primary Examiner* — Amy Cohen Johnson
*Assistant Examiner* — Daniel Wicklund
(74) *Attorney, Agent, or Firm* — Sughrue Mion, PLLC

(57) ABSTRACT

The timepiece movement has an instantaneous actuator controlled by the movement and arranged to actuate a mechanism of the movement by pushing away one element (126) of the mechanism against a return force. The actuator includes a trailing wheel (205) driven by the movement, an eccentric (207) free to rotate coaxially to the trailing wheel and arranged to abut against and therefore be driven by the trailing wheel, a small wheel (219) returned by a spring against the periphery of the eccentric, a pivoting wheel set having a projecting portion (213) free to rotate coaxially to the trailing wheel and arranged to abut against and therefore be driven by the eccentric, the projecting portion (213) of the pivoting wheel set being arranged to push the element (126) of the mechanism away in passing against a return force.

10 Claims, 5 Drawing Sheets

TIMEPIECE MOVEMENT INCLUDING AN INSTANTANEOUS ACTUATOR CONTROLLED BY THE MOVEMENT

CROSS REFERENCE TO RELATED APPLICATIONS

This application claims priority from European Patent Application Nos. 11159422.2 and 11159387.7 filed Mar. 23, 2011, the entire disclosures of which are incorporated herein by reference.

FIELD OF THE INVENTION

The present invention generally concerns a movement for a complication timepiece including an instantaneous actuator, which is controlled by the movement and arranged to actuate a mechanism of the movement by abruptly pushing an element of said mechanism away from an initial position, the actuator including a trailing wheel driven in rotation about its axis by the movement, an eccentric which is free to rotate coaxially to the trailing wheel and arranged to be stopped against and therefore driven in rotation by the trailing wheel, a hammer returned by a spring against the periphery of the eccentric and arranged to cooperate with the curve of the eccentric so as to rotate the eccentric relative to the trailing wheel, and a pivoting wheel set including a projecting portion which is free to rotate coaxially to the trailing wheel, the pivoting wheel set being arranged to be driven in rotation by the eccentric, and the projecting portion of the pivoting wheel set being arranged to push away said element of the mechanism in passing, so as to suddenly, and with practically no transition, change the state of a mechanism or a display of the movement. The present invention concerns, in particular, a movement including an actuator of this type for actuating the clamp of a running equation of time mechanism.

PRIOR ART

EP Patent Application No. 11159387.7 filed on 23 Mar. 2011 is incorporated herein by reference. This Patent Application discloses a timepiece movement including a running equation of time device for driving a minute hand to true solar time in rotation coaxially to the minute and hour hands for civil time. This equation of time device includes, in particular, a correction mechanism comprising a locking clamp for keeping the solar time minute hand secured to the civil time minute hand. The locking clamp is fitted with a control lever for moving the jaws of the clamp apart when it is actuated, and for letting the clamp close when it is no longer actuated. The function of the clamp may be likened to that of an uncoupling mechanism acting on the solar time minute hand, since it is only possible to correct the position of said hand when the jaws of the clamp are moved apart.

According to the aforementioned document, an actuator controlled by the movement is also arranged to exert pressure on the control lever of the locking clamp of the running equation of time device at regular intervals. As soon as the actuator causes the solar time minute hand to be uncoupled, the correction means can return the hand towards the angular position which is correct at that moment. Then, after several instants, the actuator stops actuating the control lever and the jaws of the clamp close again. Thereafter, the angle between the solar time minute hand and the civil time minute hand is frozen until the next actuators.

It will therefore be clear from the foregoing that the angular distance between the civil time minute hand and the solar time minute hand is determined, on the one hand, by the difference between the civil time and solar time, and on the other hand, by the position of the civil time minute hand at the precise moment when the actuator stops actuating the control lever. With this system, the civil time minute hand must therefore occupy a very precise position at the moment of locking. There is thus a requirement for an actuator for which the transition between the open state and the closed state of the locking clamp occurs cleanly and with practically no transition.

Moreover, one problem which arises more generally with complication timepieces concerns the operations performed by the user and particularly the setting of the time, or date of the timepiece. Indeed, if the user sets the time or performs any other operation on the mechanism, while the complication is working, this operation is liable to cause damage. This is why the instructions for calendar watches in particular often state that no adjustments should be carried out between 10 pm and 1 am. There is therefore a requirement for an instantaneous actuator which can limit to a minimum the time during which a complication is operating. Particularly, with the aforementioned running equation of time device, there is a requirement to reduce to a minimum the time during which the clamp is open and the solar time minute hand is uncoupled.

There are known timepieces movements which include an instantaneous actuator and which answer the definition given in the preamble. FR Patent No. 2 232 788, in particular, discloses a timepiece movement including an instantaneous calendar mechanism. This calendar mechanism is controlled by an instantaneous actuator arranged to ensure that the date and day of the week indication jumps forward. The actuator disclosed in this document is for triggering the calendar jump from one day to the next in an almost instantaneous manner. However, although the actuator disclosed is capable of being almost instantaneously triggered, it is not, by any means, arranged to return quickly to its initial position. This actuator is not therefore suitable for controlling a transitional action, i.e. an action that is limited in time and during which the actuated mechanism suddenly returns to its initial position.

BRIEF SUMMARY OF THE INVENTION

It is thus an object of the present invention to overcome the aforementioned drawbacks. The present invention achieves this object by providing a timepiece movement comprising an instantaneous actuator controlled by the movement which is in conformity with the annexed claim 1.

It will be clear that, owing to the features of the invention, the duration of the period during which the actuator pushes back the mechanism to be actuated is not determined by the rotational speed of the trailing wheel, but by a double trigger. The first trigger is the result of the spring returning the hammer against the periphery of the eccentric, whereas the second trigger is caused by said return force.

BRIEF DESCRIPTION OF THE DRAWINGS

Other features and advantages of the invention will appear upon reading the following description, given solely by way of non-limiting example, with reference to the annexed drawings, in which.

DETAILED DESCRIPTION OF ONE EMBODIMENT

The timepiece movement of the present example includes a calendar mechanism and a running equation of time device. It should be specified, however, that the present invention is not limited solely to timepiece movements of this type. On the contrary, the present invention generally concerns timepiece movements with complications.

The following description will not describe the timepiece movement as a whole, but only the running equation of time mechanism and the actuator which are the subjects of the invention. As regards the calendar, it need only be specified that the date indication is implemented in a known manner via a 31 wheel set driven at a rate of one revolution per month, and that the 31 wheel set in turn drives, via a gear train with a ratio of 1/12, an equation of time cam 101 which completes one revolution in a year. In a known manner, the radius of the equation of time cam expresses on each point of the circumference thereof the value of the difference between the civil time and true solar time for a given day of the year.

Figure 1:
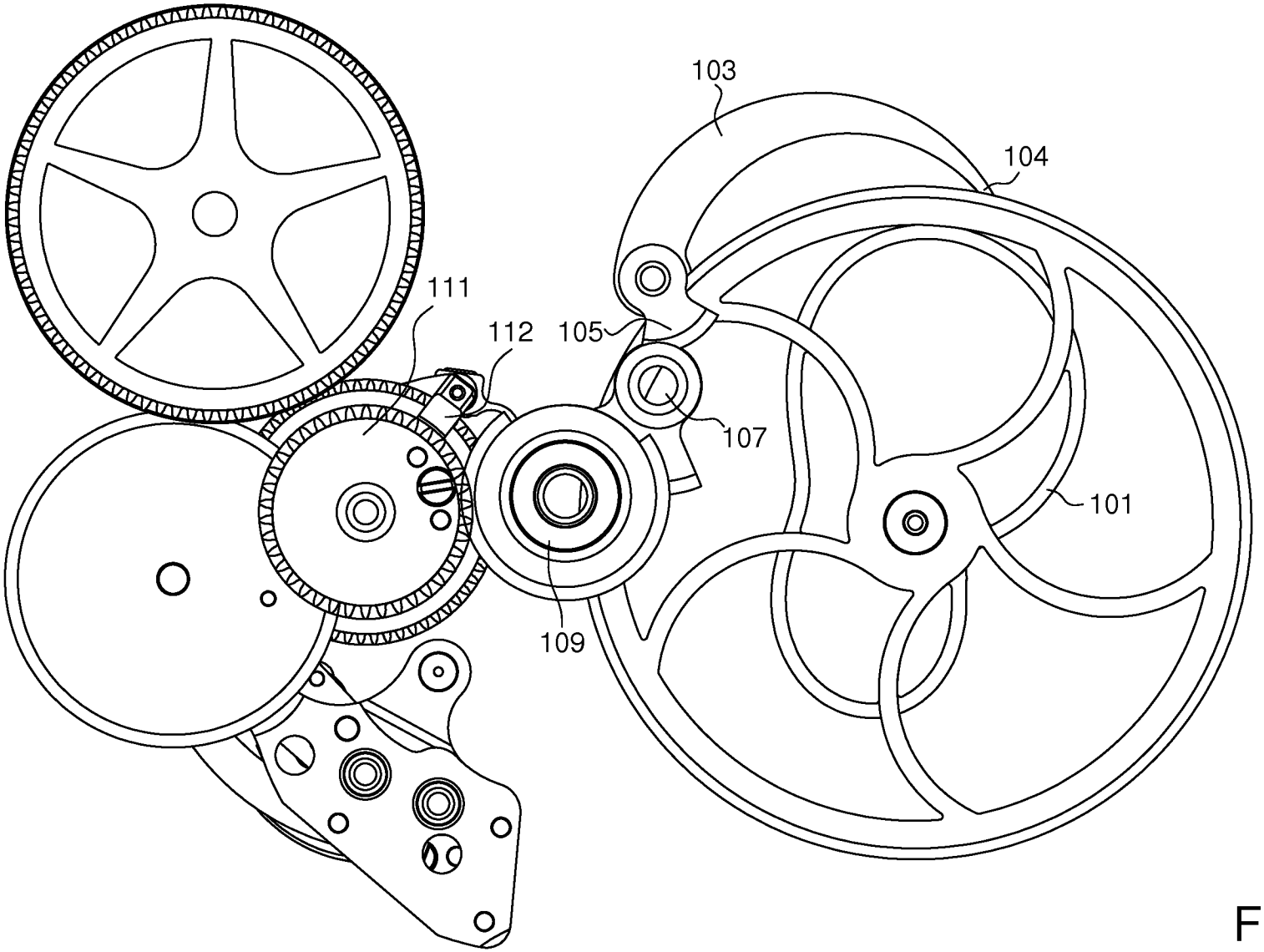
FIG. 1 is a schematic top view (from the bridge side) of an example embodiment of a running equation of time device.

Referring first of all to FIG. 1, it can be seen that the running equation of time device also includes a pivoting lever 103. This lever is subjected to a return action by a spring (not shown) which tends to press the feeler spindle 104, forming the distal end of the lever, against the periphery of the equation of time cam 101. The pivoting lever 103 rotates integrally with a first toothed sector 105 which forms the first element of a gear train actuated by the equation of time cam 101. In addition to the first toothed sector, the gear train includes a toothed wheel 111 pivotally mounted concentrically to the hands of the movement, and a first wheel set 107 formed of a pinion and a toothed sector, and a second wheel set 109 also formed of a pinion and a toothed sector. The first and second wheel sets are inserted between the first toothed sector and the toothed wheel 111. The first toothed sector 105 meshes with the pinion of the first wheel set 107, the toothed sector of the first wheel set meshes with the pinion of the second wheel set 109 and finally the toothed sector of the second wheel set meshes with the toothed wheel 111. The gear ratio of the gear train is selected according to the dimensions of the equation of time cam 101, so that a variation of one minute in the equation of time cam finally results in a 6 degree rotation of toothed wheel 111. It will thus be clear that the angular position of wheel 111 is representative of the difference between the civil time and solar time.

Figure 2:
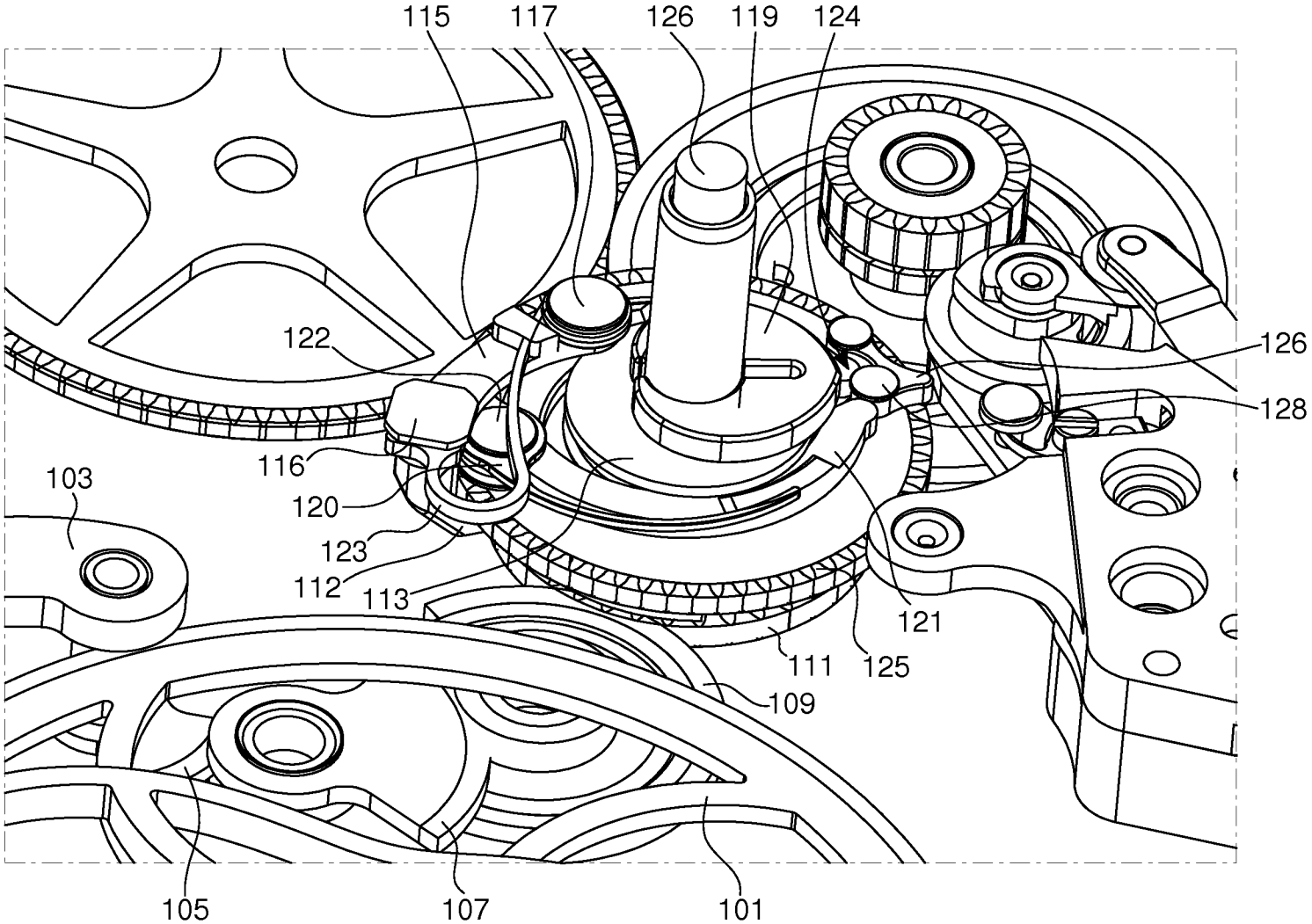
FIG. 2 is a partial perspective view of the running equation of time mechanism of FIG. 1.
Figure 4:
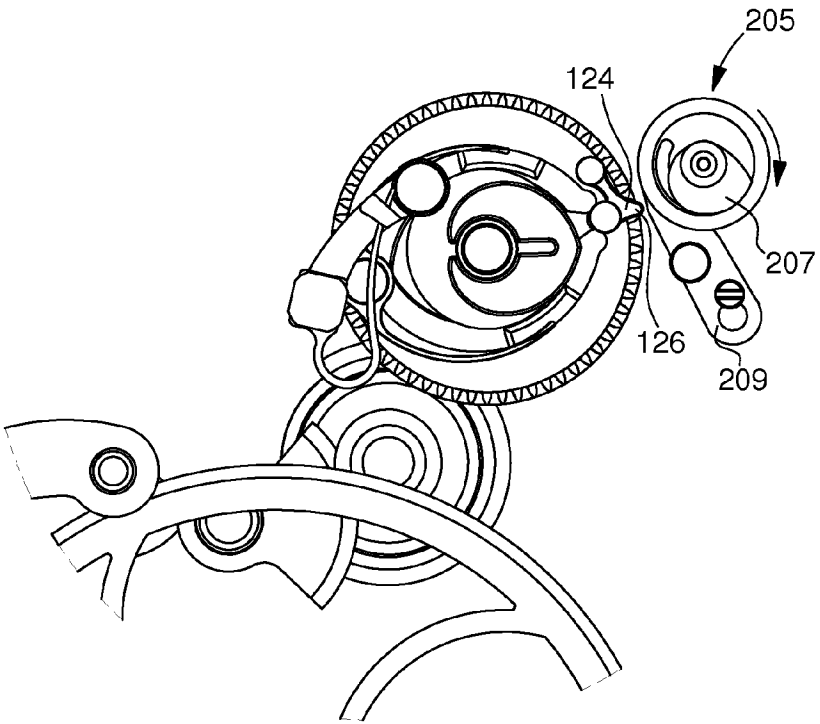
FIG. 4 is a schematic bottom view (from the dial side) showing the instantaneous actuator of FIG. 3.
Figure 3:
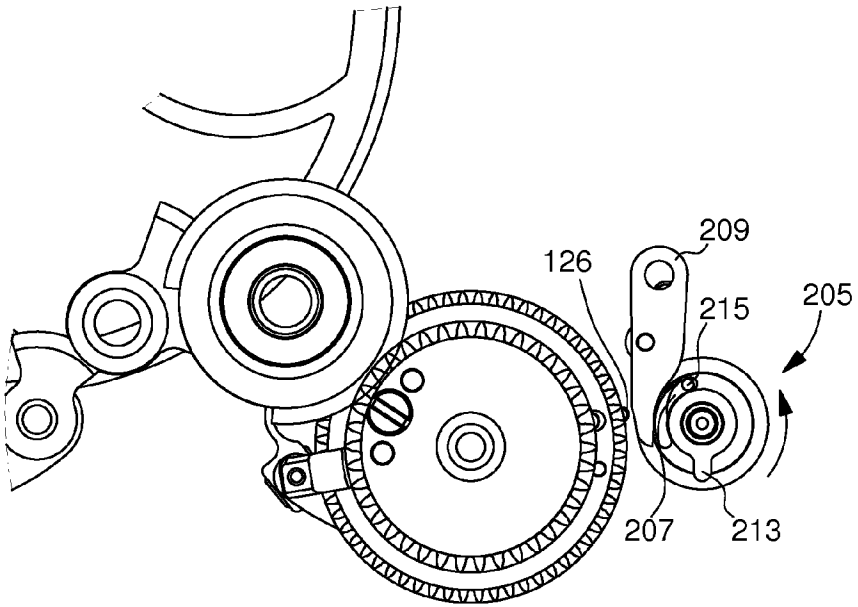
FIG. 3 is a partial, schematic, top view of the running equation of time device of FIGS. 1 and 2, showing in particular a specific embodiment of the instantaneous actuator of the present invention.

Referring now to FIG. 2, it is seen that the movement further includes a wheel set 125 whose arbour 126 carries the civil time minute hand (not shown). The wheel set 125 will be called the "false cannon-pinion". The running equation of time device also includes a pipe 113 which is loose fitted onto arbour 126 and carries the solar time minute hand (not shown). It is also seen that a locking clamp 121 surrounds pipe 113. This clamp is hinged on a pivot 122 which is fixed in an off-centre position on the plate of the false cannon-pinion 125. A double spring 120 returns the jaws of the locking clamp against the exterior of pipe 113. Finally, a small T-shaped lever 124 is pivoted on the base of the T on the plate of false cannon-pinion 125. Small lever 124 is arranged so that a force exerted on a first end 126 of the bar of the T causes the other end 128 to be inserted between the jaws of clamp 121 and to act as a wedge moving said jaws apart. It will be clear that when the jaws of the locking clamp 121 are closed, pipe 113 is integral with false cannon-pinion 125 which drives it in rotation. Thus, the angle formed by the solar time minute hand with the civil time minute hand cannot be modified while there is no force exerted on the end 126 of the small control lever 124.

The running equation of time device further includes a heart-piece 119 which is driven onto pipe 113 and an equation of time lever 115, the end of which is returned against the periphery of the heart-piece by a spring 123. Moreover, as can be seen in FIG. 1, a radial arm referenced 112 is fixed to toothed wheel 111. FIG. 2 shows that the arm 112 extends first of all radially beyond the toothing of false cannon-pinion 125 and then curve upwards and ends approximately opposite heart-piece 119. The end of arm 112 forms a small off-centre support 116 and it will be clear that the function of toothed wheel 111 with the arm 112 thereof is that of a rotating frame. FIG. 2 also shows that the small support 116 is used both as a point of anchorage for spring 123 and a pivot point for equation of time lever 115. Finally, it is seen that the equation of time lever 115 carries at the end thereof a roller 117 and that said roller is pressed against the periphery of heart-piece 119 by spring 123. In a known manner, the force exerted by roller 117 on the heart-piece has a tangential component which tends to return the heart-piece in the direction of its stable angular position of equilibrium, or, in other words, in the direction of the position where the roller is in the notch of the heart-piece.

The running equation of time device is associated with an instantaneous actuator which is specifically covered by the present invention. This instantaneous actuator which will be described in more detail hereinafter is driven by the movement.

The operation of the running equation of time device will now be described. As seen above, while no force is being exerted on control lever 124, pipe 113 and heart-piece 119 are integral with the false cannon-pinion 125 which drives said pipe and heart-piece in rotation. As will be described hereinafter, the instantaneous actuator is arranged to press on the end 126 of small lever 124 once every 3 hours. The instantaneous actuator thus forces the jaws of locking clamp 121 to half open and release their pressure on pipe 113. Released by the clamp, the pipe pivots, driven by the heart-piece, until roller 117 is immobilised in the notch of the heart-piece. It will be clear that the position occupied by the solar time minute hand at this precise moment depends on the angular position of frame 111 and thus on that of the equation of time cam 101. A few moments later, the instantaneous actuator stops pressing on control lever 124 and the jaws of clamp 121 close on pipe 113, thus freezing the angle between the two minute hands for the next 3 hours. In this regard, it will be clear that the angle between the two minute hands at the moment when clamp 121 closes on pipe 113 is determined, on the one hand, by the position of the equation of time cam and on the other hand, by the position occupied by the civil time minute hand at this moment. The position occupied by the civil time minute hand, at the moment when the locking means close again, is thus critical for the operation of a running equation of time device like that of this example.

The instantaneous actuator will now be described with reference to FIGS. 3 to 7. In the present example, the function of the instantaneous actuator is to release the running equation of time correction mechanism. As can be seen in the Figures, the instantaneous actuator includes a trailing wheel 205, a pivoting wheel set including a projecting portion, or finger, 213 (FIG. 3) which is loose mounted on the arbour of the trailing wheel, an eccentric 207 (FIG. 4), which is also loose mounted on the arbour of the trailing wheel, on the opposite side with respect to the finger, a hammer, or lever, 217 ending in a small roller 219 (FIGS. 5 and 6), and a spring (not shown) arranged to return the small roller against the periphery of the eccentric and finally a tip-lever.

In the present example, the trailing wheel 205 is driven by the motion work of the movement (not shown) at the substantially constant speed of one revolution every 3 hours. The trailing wheel will therefore be called the "3 hour wheel" hereinafter. It will be clear however that the invention is not limited to this particular rotational speed. Indeed, according to the invention, wheel 205 could be driven at absolutely any speed. It should be specified, however, that for the equation of time device of the present example to operate, wheel 205 must complete exactly one revolution in N hours, where the parameter "N" can be any integer number greater than or equal to 1. It will also be clear that the kinematic chain which drives the trailing wheel does not necessarily pass through the motion work.

Figure 6:
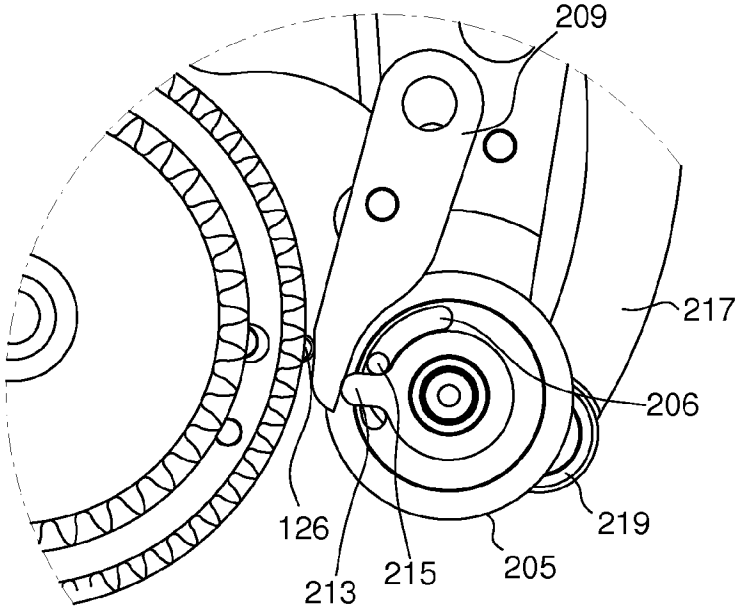
FIG. 6 is a partial view similar to that of FIG. 5 showing the configuration of the instantaneous actuator during the jump.
Figure 7:
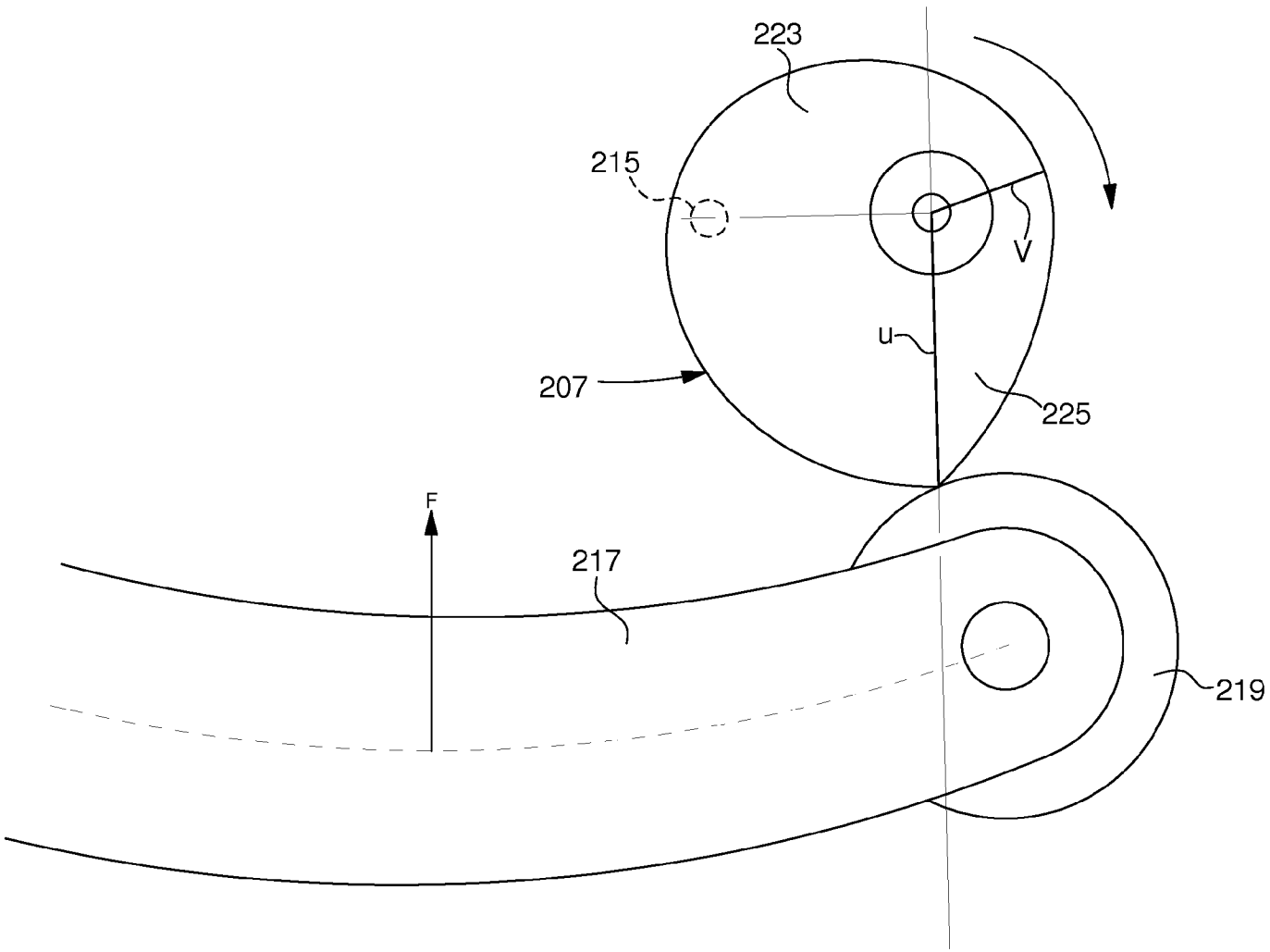
FIG. 7 is an enlarged, schematic view of the eccentric of the instantaneous actuator of FIGS. 3 to 6 in the configuration at the moment which precedes the jump.

FIG. 7 shows that, in the present example, the shape of the eccentric 207 is doubly asymmetrical. Indeed, on the one hand, the distance separating the periphery from the centre of rotation of the eccentric is not constant, and on the other hand, it is also observed that the peak of the curve (i.e. the point the furthest from the centre of rotation) is not located opposite the start of the curve (i.e. the point closest to the centre of rotation). The radius ending at the peak of the curve (referenced u) (FIG. 7) and the radius ending at the start of the curve (referenced v) thus divide the area enclosed by the curve into two unequal sectors. The larger of these sectors will be called hereinafter the "slightly sloping sector" 223 and the smaller will be called the "steeply sloping sector" 225. Referring again to FIGS. 3, 5 and 6, it can be seen that the plate of the 3 hour wheel 205 is pierced with an oblong 206, which defines an arc of a circle, and that eccentric 207 carries a pin 215, which is arranged to slide inside this oblong. The presence of the oblong allows the eccentric to pivot relative to the 3 hour wheel inside a sector whose area is limited by the two ends of the oblong.

Figure 5:
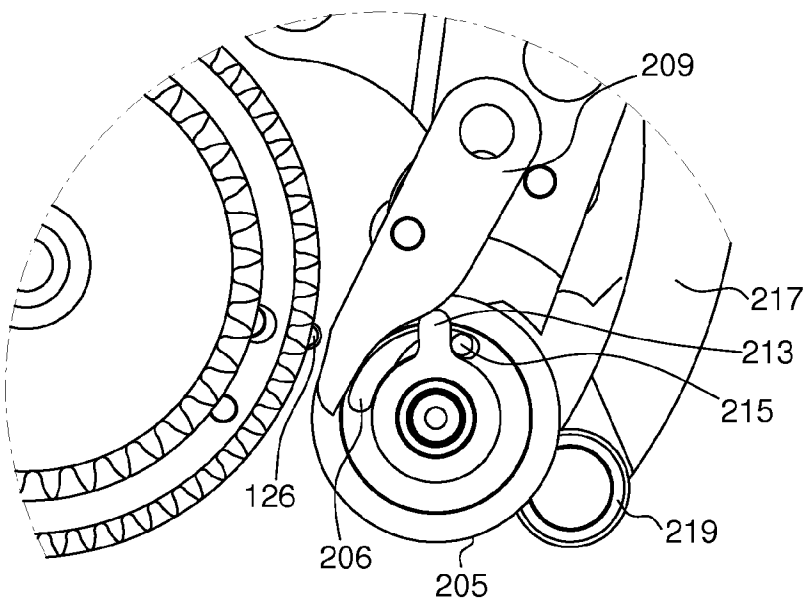
FIG. 5 is a partial, enlarged, top view showing the instantaneous actuator of FIGS. 3 and 4 in the configuration at the moment preceding the jump.

In FIG. 5, pin 215 is shown in abutment against one end of oblong 206. In this situation, the 3 hour wheel 205 drives eccentric 207 in rotation via the pin. The rotation of the eccentric forces small roller 219 to roll over the periphery of the eccentric. Moreover, the direction of rotation of the 3 hour wheel is such that the small roller rises along the curve, moving away from the centre of rotation, when it passes through the slightly sloping sector 223 and descends again, returned by the spring (not shown) in the direction of the centre of rotation, when it passes through the steeply sloping sector 225. When the small roller, which forms the head of hammer 217 passes through the steeply sloping sector, the force exerted by the spring on the sloping periphery of eccentric 207 has the effect of driving the eccentric in the same direction as the trailing wheel. Since the eccentric can pivot freely relative to the 3 hour wheel, small roller 219 quickly hurtles down the slope from the peak to the start of the curve, causing the eccentric and pin 215 to pivot suddenly in the direction of operation. The fall of the small roller ends when it is immobilised at the start of the curve (in the position shown in FIG. 6).

The length of the pin 215 is such that the end thereof overshoots oblong 206 so that it can push finger 213. In FIG. 5, finger 213 is shown in abutment against the pin. In this situation, eccentric 207 drives finger 213 in rotation via the pin. Once per revolution of the 3 hour wheel 205, the finger encounters and lifts the tip-lever 209. The instantaneous actuator is arranged so that the finger encounters the tip-lever approximately at the moment when small roller 219 starts to hurtle down the sloping periphery of the eccentric. Thus, pushed by hammer 217, the finger pivots violently, lifting tip-lever 209 and quickly sliding against the concave surface thereof, until the finger has passed the point of maximum lift of the tip-lever (as shown in FIG. 6). The spring will preferably be arranged to exert as strong a thrust as possible, so that the pivoting movement of the eccentric and the finger is very fast.

As the Figures also show, when tip-lever 209 is raised by finger 213, the back of the tip-lever presses against the end 126 of the small control lever 124 with sufficient force to half open the jaws of the locking clamp 121 and to release the pipe 113. To half open the jaws of the locking clamp, the tip-lever must force the double spring 120 and it will be clear that, in reaction, the control lever and tip-lever are then returned against the projecting portion (the finger) 213 by the double spring (120). This reaction force has no effect while finger 213 is being pushed by pin 215 and the point of maximum lift of the tip-lever has not been reached. However, as soon as the finger passes the point of maximum lift of the tip lever (FIG. 6), the tangential component of the reaction force exerted by the tip-lever on the finger is oriented in the direction of rotation. Since the finger is then free to rotate relative to the eccentric and to the 3 hour wheel, the tip-lever falls again ejecting the finger. The pressure of the tip-lever on the control lever is thus suddenly interrupted, allowing the locking clamp to immobilise the pipe at a very precise time.

It is clear from the foregoing why the actuator of the present example is called "instantaneous". Indeed, according to the invention, the duration of the period during which the actuator presses on lever 124 is not determined by the rotational speed of the trailing wheel, but by a double trigger effect which is caused first of all by the powerful return spring of the hammer 217 and then the double spring 120. Moreover, as explained hereinbefore, the instantaneous actuator also determines the moment at which the locking means releases pipe 113 and the moment at which it locks the pipe again. Since the revolutions of the trailing wheel 205 take exactly 3 hours, the position of the civil time minute hand at the moment when the locking means is actuated is always the same. The running equation of time device is preferably arranged so that the civil time minute hand occupies the "12 o'clock" position at the moment when the locking means again locks the pipe after having released said pipe for several moments.

It will also be clear that various alterations and/or improvements evident to those skilled in the art may be made to the embodiment described herein without departing from the scope of the present invention defined by the annexed claims. In particular, the presence of tip-lever 209 is not essential to the invention. Indeed, even if, in the present example, the projecting portion (the finger) 213 pushes away the element of the mechanism (control lever 124 of the running equation of time device) via tip-lever 209, the projecting portion could equally well enter directly into contact with the element of the mechanism in order to push said element away.

What is claimed is:

1. A timepiece movement including an instantaneous actuator controlled by the movement and arranged to actuate a mechanism of the movement by abruptly pushing an element of said mechanism away from an initial position, the actuator comprising a trailing wheel driven in rotation about the axis thereof by the movement, an eccentric which is free to rotate coaxially to the trailing wheel and arranged to abut against and therefore be driven by the trailing wheel, a hammer returned by a spring against the periphery of the eccentric and arranged to cooperate with the curve of the eccentric so as to rotate the eccentric with respect to the trailing wheel, a pivoting wheel set comprising a projecting portion which is free to rotate coaxially to both the trailing wheel and the eccentric, the pivoting wheel set being arranged to abut against and therefore to be driven in rotation by the eccentric and the projecting portion of the pivoting wheel set being arranged to push said element of the mechanism away in passing, wherein the projecting portion of the pivoting wheel set is arranged to move the element temporarily away from the initial position thereof against a return force, wherein the return force is arranged to then return the element of the mechanism to the initial position thereof, and wherein the pivoting wheel set is free to rotate coaxially to both the trailing wheel and the eccentric within a limited angle relative to the eccentric, so as to allow the projecting portion to move out of the way of the element of the mechanism via the pivoting of the pivoting wheel set relative to the eccentric when the element of the mechanism is returned to the initial position thereof by the return force.

2. The timepiece movement according to claim 1, wherein the hammer ends in a small roller arranged to roll over the periphery of the eccentric.

3. The timepiece movement according to claim 1, wherein the eccentric is driven by the trailing wheel via a pin arranged to slide inside an oblong so as to allow the eccentric to rotate freely relative to the trailing wheel within a determined angle, one end of the oblong and the pin further being arranged to have the possibility of abutting against each other.

4. The timepiece movement according to claim 3, wherein the pivoting wheel set comprising a projecting portion is driven by the eccentric via a pin, the projecting portion and the pin being arranged to have the possibility of abutting against each other, and wherein the eccentric is driven by the trailing wheel via the same pin which also drives the pivoting wheel set comprising a projecting portion.

5. The timepiece movement according to claim 3, wherein the oblong is formed in the plate of the trailing wheel, and wherein the pin is integral with the eccentric.

6. The timepiece movement according to claim 1, wherein the pivoting wheel set comprising a projecting portion is driven by the eccentric via a pin, the projecting portion and the pin being arranged to have the possibility of abutting against each other.

7. The timepiece movement according to claim 6, wherein the projecting portion is made in the form of a finger and wherein the pin is integral with the eccentric.

8. The timepiece movement according to claim 7, wherein an oblong is formed in the plate of the trailing wheel and the pin is arranged to slide inside the oblong so as to allow the eccentric to rotate freely relative to the trailing wheel within a determined angle, one end of the oblong and the pin further being arranged to have the possibility of abutting against each other so that the eccentric may be driven by the trailing wheel via the pin, both the eccentric and the finger of the pivoting wheel set thus being driven by the trailing wheel via the pin.

9. The timepiece movement according to claim 1, wherein the pivoting wheel set comprising a projecting portion and the eccentric are arranged on either side of the trailing wheel.

10. The timepiece movement according to claim 1, wherein the instantaneous actuator further comprises a tip-lever and wherein the projecting portion of the pivoting wheel set is arranged to push away the element of a mechanism via the tip-lever.

* * * * *